US011106158B1

(12) United States Patent
Yoshioka et al.

(10) Patent No.: US 11,106,158 B1
(45) Date of Patent: Aug. 31, 2021

(54) POWDER SUPPLY DEVICE WITH MAGNETIC BODY THAT FORMS A NAP OF MIXED AGENT

(71) Applicant: FUJIFILM BUSINESS INNOVATION CORP., Tokyo (JP)

(72) Inventors: Sakae Yoshioka, Kanagawa (JP); Takashi Sakamoto, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/984,281

(22) Filed: Aug. 4, 2020

(30) Foreign Application Priority Data

Feb. 27, 2020 (JP) ..... JP2020-031469

(51) Int. Cl.
*G03G 15/06* (2006.01)
*G03G 15/09* (2006.01)
*G03G 15/08* (2006.01)

(52) U.S. Cl.
CPC ..... *G03G 15/0928* (2013.01); *G03G 15/0865* (2013.01)

(58) Field of Classification Search
CPC ..... G03G 15/0898; G03G 15/0942; G03G 15/0887; G03G 15/0889; G03G 15/0891; G03G 15/0893; G03G 15/0844
USPC ..... 399/98, 104, 254–258, 260
See application file for complete search history.

(56) References Cited

U.S. PATENT DOCUMENTS 8,295,741 B2 * 10/2012 Kido ..... G03G 15/0848 399/260
9,098,018 B2 * 8/2015 Kashimoto et al. ..... G03G 15/0891
10,012,928 B2 * 7/2018 Iwata ..... G03G 15/0893
2015/0030354 A1 1/2015 Ishida
2018/0107136 A1 4/2018 Ishii et al.

FOREIGN PATENT DOCUMENTS

JP 2015-022261 A 2/2015
JP 2018-066822 A 4/2018
JP 2019-070685 A 5/2019

* cited by examiner

*Primary Examiner* — William J Royer
(74) *Attorney, Agent, or Firm* — Oliff PLC

(57) ABSTRACT

A powder supply device includes: a storage unit that stores a mixed agent including a functional material-containing powder and magnetic powder, the storage unit being provided with a discharge port through which a part of the stored mixed agent is discharged; a supply unit that holds the mixed agent and supplies the functional material-containing powder from the storage unit; and a magnetic body that covers at least a part of the discharge port and forms a nap of the mixed agent to prevent the mixed agent that is dispersed in air from flowing out through the discharge port.

20 Claims, 7 Drawing Sheets

POWDER SUPPLY DEVICE WITH MAGNETIC BODY THAT FORMS A NAP OF MIXED AGENT

CROSS-REFERENCE TO RELATED APPLICATIONS

This application is based on and claims priority under 35 USC 119 from Japanese Patent Application No. 2020-031469 filed Feb. 27, 2020.

BACKGROUND

1. Technical Field

The present disclosure relates to a powder supply device.

2. Related Art

A developing device is known that stores a developer including a toner and a carrier and develops an electrostatic latent image with the toner in the developer. The developer stored in a storage chamber of the developing device of this type is circulated while being agitated. Since the developer is gradually deteriorated due to the agitation, a discharge port through which the deteriorated developer is gradually discharged is provided. Then, a new developer is supplied into the storage chamber. In this way, a configuration is made such that deterioration of the developer in the storage chamber is prevented in order to always exhibit a good developing performance.

Here, JP-A-2015-022261 discloses a developing device which includes a transport screw having a transport unit that transports toward an end portion in the longitudinal direction where a discharge port is provided, and a return screw which is provided closer to the discharge port than the transport unit and which applies a force for pushing back the flow of a developer toward the discharge port. In the developing device, a magnet is arranged at the position of the returning portion near a boundary between the transport unit and the return screw.

Further, JP-A-2018-066822 discloses a developing device having a structure in which a discharge port is provided in the upper portion of a storage chamber to prevent a developer from excessively accumulating in the storage chamber and in which a magnet that attracts the developer that has been flipped up is arranged above the discharge port.

SUMMARY

A developer supply path such as a pipe is connected to a storage chamber of a developing device. When a new developer is supplied through the developer supply path, air is also pushed into the storage chamber and the atmospheric pressure inside the storage chamber tends to rise. Meanwhile, since the developer is agitated in the storage chamber, a developer (called a developer cloud) that is dispersed in the air in the storage chamber is generated. When the atmospheric pressure in the storage chamber rises, the developer cloud may head toward the discharge port, and the developer in the storage chamber may be discharged excessively beyond expectations. For this reason, a decompression structure for lowering the atmospheric pressure in the storage chamber, for example, an opening with a filter for removing air is provided. However, problems such as clogging of the filter may occur in the decompression structure, and when this happens, it may not be possible to prevent the phenomenon in which the developer in the storage chamber is excessively discharged more than expected.

Aspects of non-limiting embodiments of the present disclosure relate to providing a powder supply device that prevents discharge of a mixed agent in a storage chamber even when an atmospheric pressure in the storage chamber rises, as compared with a case where features of the present disclosure are not provided.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a powder supply device including: a storage unit that stores a mixed agent including a functional material-containing powder and magnetic powder, the storage unit being provided with a discharge port through which a part of the stored mixed agent is discharged; a supply unit that holds the mixed agent and supplies the functional material-containing powder from the storage unit; and a magnetic body that covers at least a part of the discharge port and forms a nap of the mixed agent to prevent the mixed agent that is dispersed in air from flowing out through the discharge port.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments of the present disclosure will be described.

Figure 1:
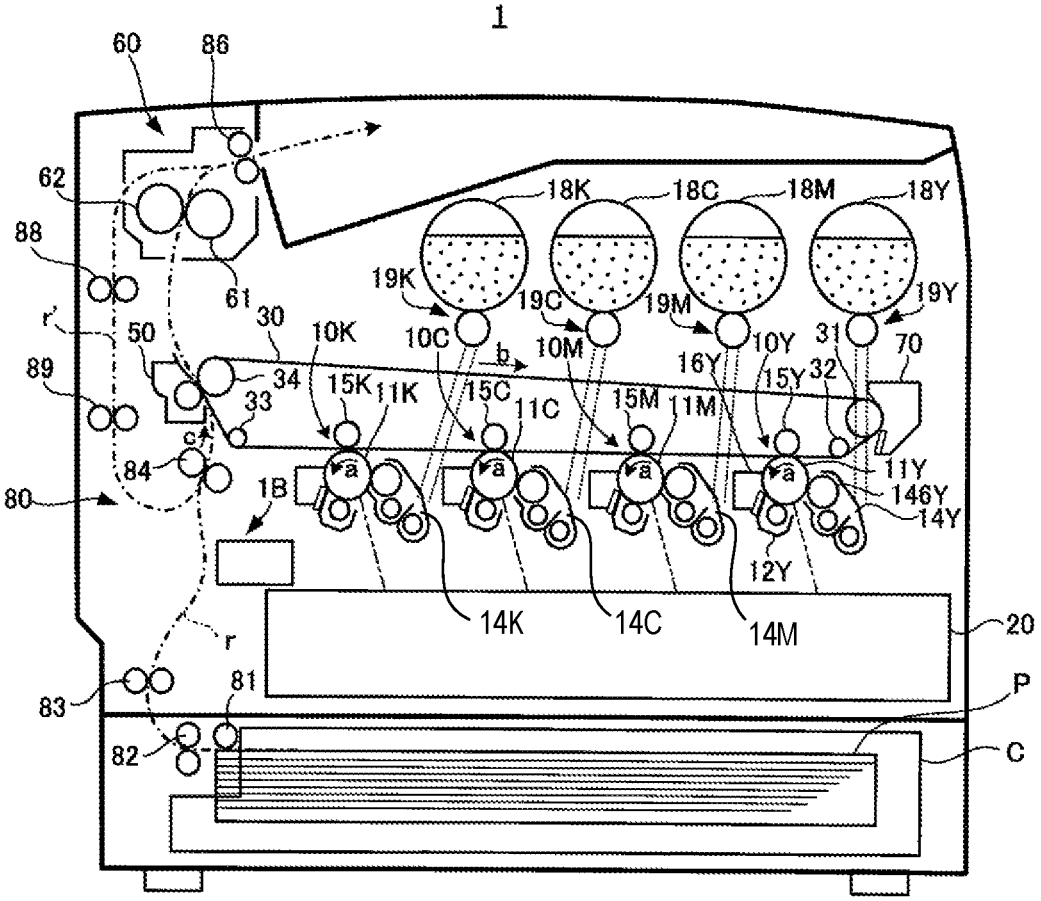
FIG. 1 is a configuration diagram illustrating an example of an image forming apparatus.

FIG. 1 is a configuration diagram illustrating an example of an image forming apparatus 1. The image forming apparatus 1 is provided with a developing device 14 which is an exemplary embodiment of a powder supply device of the present disclosure.

The image forming apparatus 1 illustrated in FIG. 1 is a tandem type color printer in which image forming units 10Y, 10M, 10C, and 10K corresponding to the respective colors of yellow (Y), magenta (M), cyan (C), and black (K) are arranged in parallel, and may print a single color image and print a full color image composed of four color toner images.

The image forming apparatus 1 includes an exposure unit 20 that irradiates each of the image forming units 10Y, 10M, 10C, and 10K with exposure light, an intermediate transfer belt 30 to which toner images are transferred from the image forming units 10Y, 10M, 10C, and 10K for each color, a secondary transfer unit 50 that transfers toner images from the intermediate transfer belt 30 onto a sheet P, a fixing device 60 that fixes the toner to the sheet P, a belt cleaner 70 that collects a toner from the intermediate transfer bell 30, a sheet transport unit 80 that transports the sheet P, and a sheet accommodating unit C that accommodates multiple sheets P. Further, the image forming apparatus 1 is also provided with toner containers 18Y, 18M, 18C, and 18K that accommodate the toner of each color of Y, M, C, and K, and toner supply devices 19Y, 19M, 19C, and 19K that transport the toner in the toner containers 18Y, 18M, 18C, and 18K to the image forming units 10Y, 10M, 10C, and 10K, respectively.

Since the four image forming units 10Y, 10M, 10C, and 10K have substantially the same configuration, the image forming unit 10Y corresponding to yellow will be described as a representative of the colors. The image forming unit 10Y includes a photoconductor 11Y, a charger 12Y, a developing device 14Y, a primary transfer unit 15Y, and a photoconductor cleaner 16Y. The photoconductor 11Y has a cylindrical surface, carries an image formed on the surface, and rotates in the direction of an arrow a around the axis of the cylinder. Similarly, the image forming units 10M, 10C, and 10K each include a primary transfer unit 15M, 15C, and 15K, respectively.

The charger 12Y has a charging roller that rotates while being in contact with the photoconductor 11Y, and charges the surface of the photoconductor 11Y.

The developing device 14Y contains a developer including toner and a magnetic carrier.

The developer corresponds to an example of a mixed agent referred to in the present disclosure. Further, the toner and the magnetic carrier respectively correspond to examples of a powder containing a functional material and a magnetic powder in the present disclosure. However, the powder containing the functional material referred to in the present disclosure is not limited to the toner and may be a material having a certain physical/chemical function. This function also includes, for example, a coloring function.

The developing device 14Y includes a developing roller 146Y, and the developing roller 146Y transports the developer to the photoconductor 11Y. The toner of the developer adheres to the photoconductor 11Y to form a toner image on the photoconductor 11Y. The toner container 18Y and the toner supply device 19Y replenish the developing device 14Y with new toner. A toner transport mechanism (not illustrated) that is driven by the control of a controller 1B is provided in the toner supply device 19Y. The primary transfer unit 15Y transfers the toner image to the intermediate transfer belt 30. The photoconductor cleaner 16Y cleans the surface of the photoconductor 11Y after transfer.

The exposure unit 20 emits exposure light based on an image signal supplied from the outside, and exposes the photoconductors 11Y, 11M, 11C, and 11K with the emitted light.

The intermediate transfer belt 30 is an endless belt-shaped member supported by belt support rollers 31, 32, 33, and 34, and revolves in a direction indicated by an arrow b passing through the image forming units 10Y, 10M, 10C, and 10K and the secondary transfer unit 50. The intermediate transfer belt 30 carries the toner images of the respective colors formed by the image forming units 10Y, 10M, 10C, and 10K.

The secondary transfer unit 50 is a roller that sandwiches the intermediate transfer belt 30 and a sheet P between the roller and a backup roller 34, which is one of the belt support rollers 31 to 34, and rotates. A voltage is supplied between the secondary transfer unit 50 and the backup roller 34 to generate an electric field for transferring toner, and the toner image on the intermediate transfer belt 30 is transferred onto a sheet P.

The belt cleaner 70 brings a blade into contact with the intermediate transfer belt 30 to remove the toner on the intermediate transfer belt 30.

The fixing device 60 includes a heating roller 61 and a pressure roller 62, and fixes the toner image on the sheet P by sandwiching and passing the sheet P on which the toner image before fixing is formed.

The sheet transport unit 80 takes out the sheet P from the sheet accommodating unit C and transports the sheet P along a sheet transport path r passing through the secondary transfer unit 50 and the fixing device 60. The sheet transport unit 80 includes a pickup roller 81 that takes out the sheet P stored in the sheet accommodating unit C, a retard roller 82 that handles the taken-out sheet P, a transport roller 83 that transports the sheet P, a registration roller 84 that transports the sheet P to the secondary transfer unit 50, a discharge roller 86 that discharges the sheet P to the outside, and reverse transport rollers 88 and 89 that transport the sheet P during duplex printing.

To explain the basic operation of the image forming apparatus 1 illustrated in FIG. 1, in the yellow image forming unit 10Y, the photoconductor 11Y is rotationally driven in the direction of the arrow a, and electric charges are given to the surface of the photoconductor 11Y by the charger 12Y. This also applies to the image forming units 10M, 10C, and 10K corresponding to colors other than yellow. The exposure unit 20 irradiates the photoconductors 11Y, 11M, 11C, and 11K with exposure light according to the data corresponding to each color in the image signal. To describe yellow (Y) as a representative, the exposure unit 20 irradiates the surface of the photoconductor 11Y with exposure light based on the image signal corresponding to yellow of the image signals supplied from the outside to form an electrostatic latent image on the surface of the photoconductor 11Y. The developing device 14Y forms a toner image by developing the electrostatic latent image with yellow toner. Toner is supplied to the developing device 14Y from a toner container 18Y by a toner supply device 19Y. The photoconductor 11Y rotates while carrying the yellow toner image formed on the surface thereof. The toner image formed on the surface of the photoconductor 11Y is transferred to the intermediate transfer belt 30 by the primary transfer unit 15Y that supplies a transfer potential between the surface of the photoconductor 11Y and the intermediate transfer belt 30. After the transfer, the toner remaining on the photoconductor 11Y is collected and removed by the photoconductor cleaner 16Y.

The intermediate transfer belt 30 is supported by the support rollers 31 to 34 and is circulated in the direction of the arrow b. The image forming units 10M, 10C, and 10K corresponding to colors other than yellow form toner images corresponding to the respective colors in the same manner as the image forming unit 10Y, and transfer the toner images of the respective colors onto the intermediate transfer belt 30 so as to be superimposed on the toner images transferred from the image forming unit 10Y.

In the meantime, the sheet P in the sheet accommodating unit C is taken out by the pickup roller 81, and is transported by the retard roller 82, the transport roller 83, and the registration roller 84 through the sheet transport path r in the direction of an arrow c toward the secondary transfer unit 50. The sheet P is sent to the secondary transfer unit 50 by the registration roller 84 at the timing when the toner image is transferred onto the intermediate transfer belt 30. The secondary transfer unit 50 transfers the toner image on the intermediate transfer belt 30 to the sheet P by applying a transfer bias potential between the intermediate transfer belt 30 and the sheet P. The sheet P onto which the toner image has been transferred by the secondary transfer unit 50 is transported to the fixing device 60, and the toner image transferred onto the sheet P is fixed. In this way, an image is formed on the sheet P. The sheet P on which the image is formed is discharged by the discharge roller 86 to the upper portion of the image forming apparatus 1. The toner remaining on the intermediate transfer belt 30 after being transferred by the secondary transfer unit 50 is removed by the belt cleaner 70.

In the case of duplex printing in which an image is also formed on the back side of the surface on which the image is formed, the discharge roller 86 discharges the sheet P halfway through the discharge port 148 and then transports the sheet P in the opposite direction. The sheet P transported in the opposite direction is transported by the reverse transport rollers 88 and 89 via a reverse transport path r'. The transported sheet P is fed from the registration roller 84 to the secondary transfer unit 50 in a state of being turned upside down, and an image is also formed on the back surface.

Figure 2:
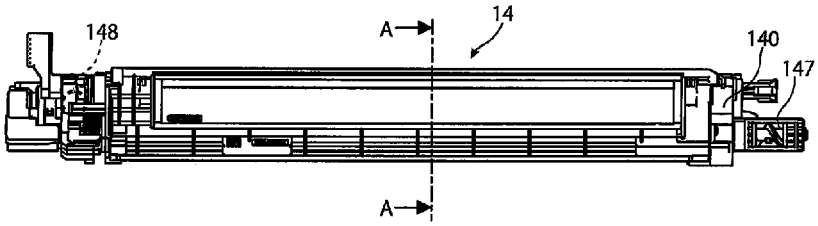
FIG. 2 is a plan view of a developing device.

FIG. 2 is a plan view of the developing device 14.

The image forming apparatus 1 illustrated in FIG. 1 includes four developing devices 14Y, 14M, 14C, and 14K, but all the devices have substantially the same configuration. Therefore, in the description from FIG. 2 onward, the symbols Y, M, C, and K representing the colors of the toners are removed and simply referred to as the developing device 14. The same applies to the respective elements of the developing device 14. Further, the same applies to the elements other than the developing device 14 when described with reference to FIG. 1.

FIG. 2 illustrates the upper surface of the developing device 14, and a housing 140 of the developing device 14 is provided with a supply port 147 that opens upward and receives the toner. Further, the housing 140 of the developing device 14 is also provided with a discharge port 148 through which the developer is discharged. The discharge port 148 is an opening that opens downward, and here, the position where the discharge port 148 is provided is indicated by a dashed circle. The supply port 147 and the discharge port 148 will be described later.

Figure 3:
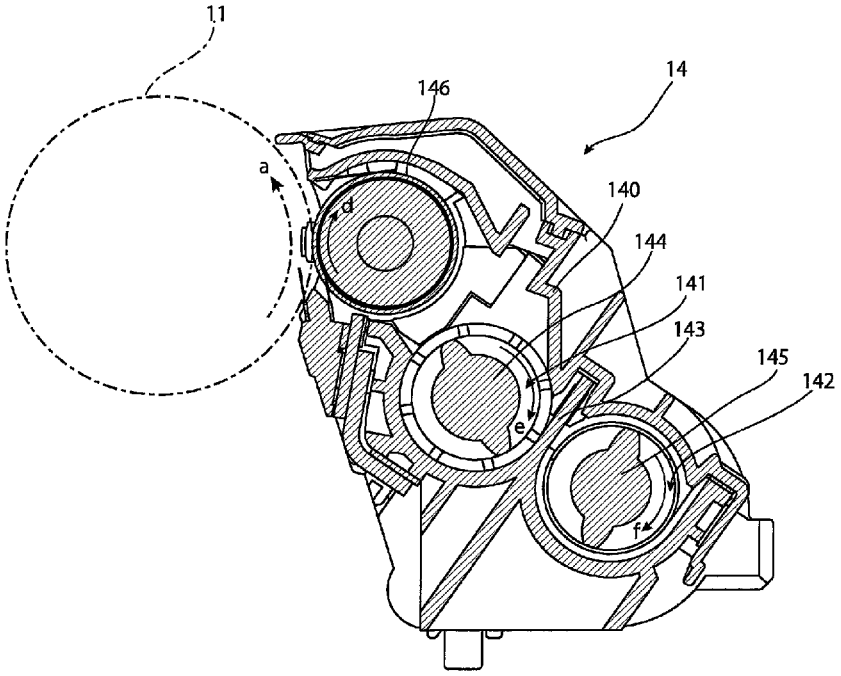
FIG. 3 is a cross-sectional view taken along an arrow A-A illustrated in FIG. 2.

FIG. 3 is a cross-sectional view taken along the arrow A-A illustrated in FIG. 2.

Figure 4:
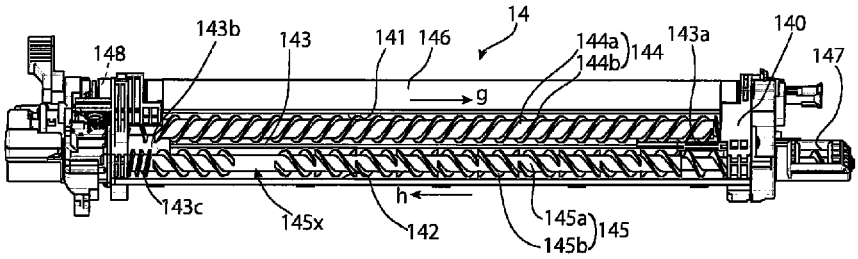
FIG. 4 is an internal configuration diagram of the developing device.

Further, FIG. 4 is an internal configuration diagram of the developing device 14.

The developing device 14 is provided with two storage chambers, each of which includes a first chamber 141 and a second chamber 142, in which a developer is stored, in the housing 140 thereof. The two storage chambers (the first chamber 141 and the second chamber 142) are separated from each other by a partition wall 143. The first chamber 141 is provided with a supply auger 144, and the second chamber 142 is provided with an admix auger 145. As illustrated in FIG. 4, the supply auger 144 and the admix auger 145 extend in a rod shape and are arranged horizontally and in parallel with each other. The supply auger 144 has a rotation shaft 144*a* having a circular cross-section, and a spiral blade 144*b* that extends in the direction of the rotation shaft 144*a* while swirling around the rotation shaft 144*a*. Similarly to the supply auger 144, the admix auger 145 also has a rotation shaft 145*a* having a circular cross-section, and a spiral blade 145*b* that extends in the direction of the rotation shaft 145*a* when swirling around the rotation shaft 145*a*.

The supply auger 144 and the admix auger 145 rotate in the directions of arrows e and f, which are the same as each other, as illustrated in FIG. 3. The spiral blade 144*b* of the supply auger 144 and the spiral blade 145*b* of the admix auger 145 are spiral blades that swirl in opposite directions. When the supply auger 144 and the admix auger 145 rotate in the same direction as indicated by the arrows e and fin FIG. 3, the developers in the first chamber 141 and the second chamber 142 are transported in opposite directions while being agitated. That is, the developer in the first chamber 141 in which the supply auger 144 is arranged is transported in the direction of an arrow g illustrated in FIG. 4 by the rotation of the supply auger 144 in the direction of the arrow e. The developer in the second chamber 142 in which the admix auger 145 is arranged is transported in the direction of an arrow h illustrated in FIG. 4 by the rotation of the admix auger 145 in the direction of the arrow f. Here, the admix auger 145 has a portion 145*x* where the spiral blade 145*b* is interrupted. This is because a sensor (not illustrated) that detects a toner concentration of the developer in the developing device 14 (a ratio of toner to carrier) is provided at a position of the developing device 14 corresponding to the portion 145*x* where the spiral blade 145*b* is interrupted and interference with the sensor is avoided.

Meanwhile, the partition wall 143 that partitions the first chamber 141 and the second chamber 142 has a first window 143*a* and a second window 143*b* that connect the first chamber 141 and the second chamber 142 at both end portions thereof. For this reason, the developer in the first chamber 141 transported in the direction of the arrow g flows into the second chamber 142 through the first window 143*a*, and the developer in the second chamber 142 transported in the direction of the arrow h flows into the first chamber 142 through the second window 143*b*. In this way, the developer in the developing device 14 circulates in the first chamber 141 and the second chamber 142 while being agitated.

Here, in the case of the present exemplary embodiment, as illustrated in FIG. 3, the floor surface of the first chamber 141 is located higher than the floor surface of the second chamber 142. Therefore, when the developer in the first chamber 141 flows into the second chamber 142 through the first window 143*a*, the developer flows down into the second chamber 142. When the developer in the second chamber 142 flows into the first chamber 141 through the second window 143*b*, the developer is pushed up into the first chamber 141 as follows.

On the downstream side of the admix auger 145 in the direction of the arrow h, another spiral blade 143*c* swirls in the opposite direction to the spiral blade 145*b*. A boundary between the spiral blade 145*b* that transports the developer in the direction of the arrow h and the spiral blade 143*c* that swirls in the opposite direction is located in a region of the second window that is connected to the first chamber 141. The developer pushed by the spiral blades 145*b* of the admix auger 145 and transported in the direction of the arrow h is pushed back by the spiral blades 143*c* swirling in the opposite direction when the developer tries to proceed further downstream than the second window 143*b*. Therefore, the developer that has been transported to the second window 143*b* in the direction of the arrow h is pushed up to the first chamber 141 located at a higher position through the second window 143*b*.

In the developing device 14 of the present exemplary embodiment, the first chamber 141 and the second chamber 142 are obliquely arranged in the vertical direction as described above, so that the width dimension of the developing device 14 is kept or reduced, the size of the developing device 14 is reduced, and the size of the image forming apparatus 1 is reduced.

Further, the developing device 14 includes a developing roller 146 at a position adjacent to the first chamber 141 in which the supply auger 144 is arranged. A part of the developing roller 146 is exposed from the housing 140. The developing device 14 is disposed in the image forming apparatus 1 (see, for example, FIG. 1) so that the exposed portion of the developing roller 146 is close to the photoconductor 11.

The developing roller 146 causes the developer in the first chamber 141 to adhere to its surface by magnetic force, rotates in the direction of an arrow d, and transports the developer to a position facing the photoconductor 11. Then, the electrostatic latent image formed on the surface of the photoconductor 11 is developed with the toner in the developer, and a toner image is formed on the surface of the photoconductor 11. Meanwhile, the developer attached to the surface of the developing roller 146 after the development with the toner returns to the inside of the housing 140 as the developing roller 146 rotates, separates from the developing roller 146, and is agitated while circulating together with other developers in the first chamber 141.

When the development with the toner as described above is repeated, the toner in the developer inside the developing device 14 decreases. Therefore, the developing device 14 is provided with a supply port 147 for receiving the toner, and the toner in the toner container 18 illustrated in FIG. 1 is supplied into the developing device 14 by the toner supply device 19. As illustrated in FIG. 4, the supply port 147 is provided further upstream than the first window 143*a* of the second chamber 142 in which the admix auger 145 is arranged (on the side opposite to the direction indicated by the arrow h). The admix auger 145 extends to the position where the supply port 147 is provided. Thus, the toner supplied from the supply port 147 is transported in the second chamber 142 to the downstream side (the direction indicated by the arrow h), merges with the developer that has flowed in through the first window 143*a*, and is transported further downstream in the second chamber 142 (the direction indicated by the arrow h).

A discharge port 148 is provided on the lower surface of the developing device 14. The developer in the developing device 14 is gradually discharged through the discharge port 148. The developer in the developing device 14 is discharged gradually through the discharge port 148, so that excessive deterioration of the developer in the developing device 14 due to agitation and transport is prevented. Not only the toner but also the carrier is discharged together through the discharge port 148. Therefore, the toner supplied from the supply port 147, that is, the loner in the toner container 18 (see, for example, FIG. 1) also contains a small amount of carrier to compensate for the decrease in carrier.

The discharge port 148 through which the developer in the developing device 14 is gradually discharged is provided at a position indicated by a dashed circle in FIGS. 2 and 4, and is opened downward. That is, the discharge port 148 is provided at a position further upstream of the second window 143*b* into which the developer in the second chamber 142 flows with respect to the developer transport direction in the first chamber 141 in which the supply auger 144 is arranged (the direction indicated by the arrow g). Most of the developer that has flowed into the first chamber 141 through the second window 143*b* is transported to the downstream side (the direction indicated by the arrow g), but a part of the developer advances to the upstream side, that is, the discharge port 148 side, and is discharged to the outside of the developing device 14 through the discharge port 148. The developer discharged through the discharge port 148 to the outside of the developing device 14 is stored in a waste toner tank (not illustrated) through a waste toner discharge path (not illustrated).

Figure 5:
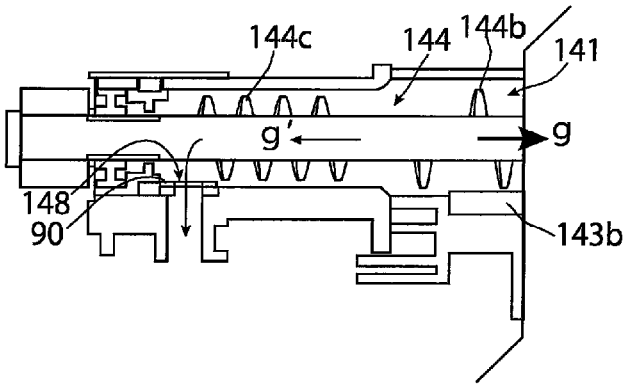
FIG. 5 is a vertical cross-sectional view near a discharge port.

FIG. 5 is a vertical cross-sectional view of the vicinity of the discharge port 148.

Figure 6A:
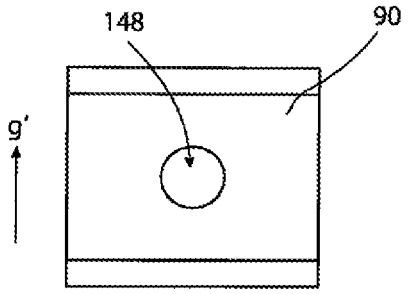
FIGS. 6A and 6B are plan views of the discharge port as seen downward from the inside of the developing device.

The discharge port 148 is a circular opening which is provided at the end portion of the first chamber 141 and opens downward (see, for example, FIG. 6A). The supply auger 144 provided with the spiral blade 144*b* is disposed in the first chamber 141. Most of the developer pushed up into the first chamber 141 through the second window 143*b* is transported in the direction of the arrow g by the spiral blade 144*b*. However, the supply auger 144 is provided with another spiral blade 143*c* that swirls in the opposite direction to the spiral blade 144*b*, at a position closer to the discharge port 148 than the spiral blade 144*b*. Then, a part of the developer pushed up into the first chamber 141 through the second window 143*b* is carried by the spiral blade 143*c* in the direction of an arrow g', and is discharged through the discharge port 148 opened downward. Here, the first chamber 141 corresponds to an example of a storage unit according to the present disclosure. Further, the supply auger 144 corresponds to an example of a transport unit according to the present disclosure, and each portion of the supply auger 144 provided with the spiral blades 144*b* and 143*c* corresponds to an example of a first transport unit and a second transport unit, respectively, according to the present disclosure.

Here, contrary to the exemplary embodiment described here, a developing device is also known which includes a transport member having a first spiral blade in the transport direction that transports toward an end portion in the longitudinal direction where the discharge port 148 is provided, and a second spiral blade that is provided closer to the discharge port 148 than the transport unit and applies a force that pushes back the flow of the developer toward the discharge port 148 in the opposite direction. In this case, the portions of the transport member provided with the first spiral blade and the second spiral blade are a first transport unit and a second transport unit, respectively, and the transport member also corresponds to an example of the transport unit according to the present disclosure.

A rubber magnet 90 is arranged around the discharge port 148. The rubber magnet 90 is a magnet that forms a nap 91 of the developer to cover the discharge port 148 and prevent the toner dispersed in the air from flowing out through the discharge port 148. The rubber magnet 90 will be described below.

Figure 6B:
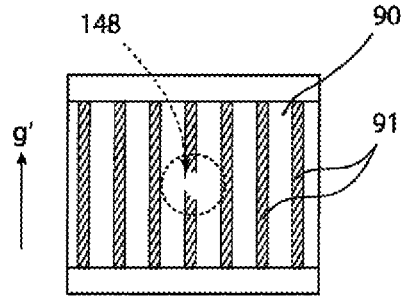

FIGS. 6A and 6B are plan views of the discharge port 148 as seen downward from the inside of the developing device 14. Here, FIG. 6A is a schematic view illustrating a state where the developer is empty, and FIG. 6B is a schematic view illustrating a state where the nap 91 of the developer is formed.

The rubber magnet 90 is provided with a hole that communicates with the discharge port 148 through which the developer is discharged. In the rubber magnet 90, the S pole and the N pole are magnetized in parallel with each other at equal intervals so that the S pole and the N pole extend in the direction of the arrow g' in which the developer is transported, that is, in the direction connecting both end portions of the first chamber 141. Then, nap 91 of the developer is formed on the rubber magnet 90 along the S pole and the N pole. Since the rubber magnet 90 is magnetized so as to extend in the direction of the arrow g', the developer may smoothly flow between adjacent naps 91, and the interference of the flow of the developer by the naps 91 is minimized.

In FIG. 6B, the position of the discharge port 148 is indicated by a broken circle. The naps 91 spreads over the discharge port 148, and the discharge port 148 is covered with the nap 91 for the most part. Here, in the present exemplary embodiment, the rubber magnet 90 is magnetized with the S pole and the N pole in a direction in which the bottom surface of the first chamber 141 in which the discharge port 148 is provided extends. This is because this configuration forms the nap 91 more effectively than, for example, a configuration in which the S pole is disposed on the back surface of the rubber magnet 90 and, for example, the N pole is disposed on the front surface thereof. Further, in the present exemplary embodiment, the magnetized rubber magnet 90 is adopted so that a distance between the adjacent S and N poles of the rubber magnet 90 is shorter than a dimension of the discharge port 148 in the direction intersecting the direction of the arrow g'. In this way, the discharge port 148 is almost covered with the nap 91.

Inside the housing 140 of the developing device 14, the developer circulates while being agitated. For this reason, inside the housing 140, there is a so-called toner cloud, that is, toner that has risen into the air inside the housing 140. The inside of the housing 140 is in a considerably sealed environment so that the toner cloud does not leak and pollute the surroundings. Toner is supplied from the supply port 147 into the housing 140. As the toner is supplied, air also enters the housing 140. Therefore, the air pressure inside the housing 140 tends to be higher than the atmospheric pressure. When the air pressure inside the housing 140 increases, the air tries to escape from the discharge port 148. However, the air in the housing 140 is in the state of a toner cloud, and therefore, there is a risk that the toner may come out of the housing 140 beyond the allowable range. For this reason, the housing 140 may be provided with a decompression structure in which a hole for venting air (not illustrated) is provided and a filter for preventing toner from flowing out is attached to the hole. However, it is not sufficient even when the decompression structure is provided, and there may be a case where the decompression structure does not work well, such as clogging of a filter. In that case, the developer cloud may exceed the allowable range and come out of the discharge port 148.

In order to prevent this, it is conceivable to make the opening of the discharge port 148 small. Making the opening small prevents the outflow of the developer cloud to a certain extent. Originally, the discharge port 148 is intended to gradually discharge the developer as a powder in which the toner and the magnetic carrier are mixed, rather than the developer that has risen up like a developer cloud. Therefore, when the opening of the discharge port 148 is made too small, the original purpose is not met, and therefore there is a limit to making the opening small.

Therefore, in the case of the developing device 14 of the present exemplary embodiment, the rubber magnet 90 is arranged around the discharge port 148, and the discharge port 148 is covered with the nap 91 of the developer. This prevents the developer cloud from flowing out. Meanwhile, not the developer cloud, but the developer as a powder in which the toner and the magnetic carrier are mixed is heavier than the toner cloud. Therefore, the nap 91 covering the discharge port 148 are easily pushed away by the mixed developer, and the mixed developer is normally discharged. However, in terms of preventing the developer cloud from being discharged, the discharge port 148 may have as small an opening as possible within a range where the mixed developer is normally discharged, and the mixed developer may easily pass through the discharge port 148. A circular opening is adopted here.

Figure 7:
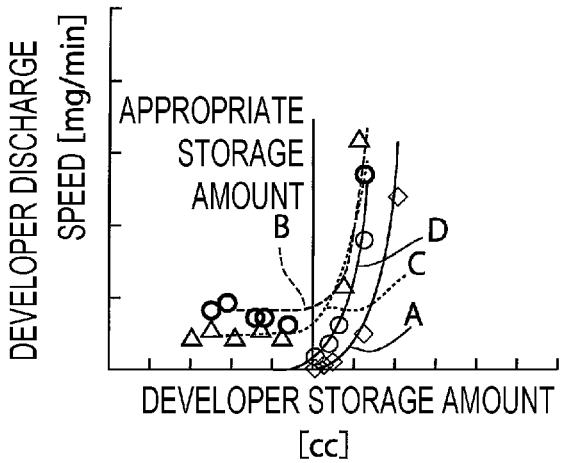
FIG. 7 is a graph illustrating a discharge speed of the developer in a housing.

FIG. 7 is a graph illustrating the discharge speed of the developer in the housing. The horizontal axis of the graph indicates the amount of developer (cc) in the housing, and the vertical axis thereof indicates the developer discharge speed (mg/min).

The appropriate amount of the developer existing in the housing 140 is determined by the volume of the housing 140.

Graphs A and B are graphs of the developing device having a rectangular discharge port which is wider than the circular discharge port 148 illustrated in FIGS. 6A and 6B, and correspond to a comparative example with respect to the present exemplary embodiment. Here, the rubber magnet 90 is not arranged.

Graph A in graphs A and B is a graph in the case where the decompression structure is normally operating. In this case, the developer discharge speed (mg/min) is extremely slow until the amount of developer in the housing 140 exceeds the appropriate amount of stored developer, and when the amount of developer exceeds the appropriate amount of developer, the developer discharge speed (mg/min) is rapidly increased. This means that there is no problem when the decompression structure is operating normally.

Graph B is a graph when the action of the decompression structure is stopped. In this case, even when the appropriate amount of developer is not exceeded, the developer discharge speed (mg/min) is considerably high. The main cause is the outflow of toner cloud.

Graph C is a graph when the discharge port 148 has a circular shape with the same size as that of the present exemplary embodiment, but the action of the decompression structure is stopped without providing the rubber magnet 90.

Compared with graph B, narrowing the opening of the discharge port 148 is effective, but there is still room to prevent the developer cloud from flowing out.

Graph D is a graph of the present exemplary embodiment in which the rubber magnet 90 is arranged. The decompression structure has stopped working. In the case of graph D, it may be seen that the toner cloud is strongly prevented from flowing out, and the developer discharge speed (mg/min) is rapidly increased when the amount of the developer exceeds an appropriate amount. That is, it may be seen that the rubber magnet 90 is effectively operating.

In the present exemplary embodiment, descriptions have been made for the example in which the rubber magnet 90 is arranged around the discharge port 148. However, it is sufficient that the nap 91 is formed so as to cover at least a part of the discharge port 148, and the rubber magnet 90 is not necessarily arranged around the discharge port 148. The rubber magnet 90 may be arranged at a place apart from the discharge port 148 when the nap 91 is formed so as to cover at least a part of the discharge port 148, such as a wall surface facing the discharge port 148.

Further, in the present exemplary embodiment, the rubber magnet 90 is adopted, but it is not always necessary that the rubber magnet 90 is a rubber magnet. It is noted that when the bottom surface of the first chamber 141 is curved, a flexible rubber magnet works more effectively.

Although the tandem image forming apparatus has been described as an example here, the present disclosure may be applied to a monochrome printer as it is.

Further, in the above-described exemplary embodiment, descriptions have been made for an example in which the powder supply device is applied to the electrophotographic developing device. However, the present disclosure is not limited thereto and may be applied to uses other than development.

For example, a powder coating device may use the developer in each of the above-described exemplary embodiments as coating powder. Specifically, the developing device in each of the exemplary embodiments is used as a powder coating head in the electrostatic powder coating method, and the electrically conductive sheet-shaped medium is transported in the vicinity of the powder coating head. By applying a bias voltage between the powder coating head and the conductive sheet-shaped medium, the charged coating powder (for example, thermosetting toner) is applied onto the sheet-shaped medium. Then, when the sheet-shaped medium is heated, the surface of the sheet-shaped medium is coated.

Further, the present disclosure may be applied to other manufacturing devices that use powder. For example, it may be applied to a manufacturing apparatus for manufacturing an electrode body of a secondary battery, which apparatus transports carbon black used for manufacturing.

In addition, the use of powder such as chemical powder and food powder is not limited, and the form of the device is not limited when the device uses powder like a manufacturing device, a processing device, and an inspection device.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder supply device comprising:

a storage unit that stores a mixed agent including a functional material-containing powder and magnetic powder, the storage unit being provided with a discharge port through which a part of the stored mixed agent is discharged;

a supply unit that holds the mixed agent and supplies the functional material-containing powder from the storage unit; and a magnetic body that covers at least a part of the discharge port and forms a nap of the mixed agent to prevent the mixed agent that is dispersed in air from flowing out through the discharge port.

2. The powder supply device according to claim 1, wherein the discharge port is an opening provided on a bottom surface of a first end portion that is one end portion of the storage unit, the opening being opened downward.

3. The powder supply device according to claim 2, wherein the discharge port is a circular opening.

4. The powder supply device according to claim 3, wherein the magnetic body has an S pole and an N pole that are magnetized so as to be arranged in a direction in which a bottom surface of the storage unit extends.

5. The powder supply device according to claim 4, wherein the S pole and the N pole of the magnetic body extend along a line connecting both end portions of the storage unit.

6. The powder supply device according to claim 5, wherein a distance between the S pole and the N pole at least in a vicinity of the discharge port in the magnetic body is shorter than a dimension of the discharge port in a direction that intersects the line connecting both the end portions of the storage unit.

7. The powder supply device according to claim 4, wherein a distance between the S pole and the N pole at least in a vicinity of the discharge port in the magnetic body is shorter than a dimension of the discharge port in a direction that intersects a line connecting both end portions of the storage unit.

8. The powder supply device according to claim 4, wherein the magnetic body is a magnetic body in which a plurality of the S poles and a plurality of the N poles are arranged in parallel at equal intervals.

9. The powder supply device according to claim 2, wherein the magnetic body has an S pole and an N pole that are magnetized so as to be arranged in a direction in which a bottom surface of the storage unit extends.

10. The powder supply device according to claim 9, wherein the S pole and the N pole of the magnetic body extend along a line connecting both end portions of the storage unit.

11. The powder supply device according to claim 10, wherein a distance between the S pole and the N pole at least in a vicinity of the discharge port in the magnetic body is shorter than a dimension of the discharge port in a direction that intersects the line connecting both the end portions of the storage unit.

12. The powder supply device according to claim 9, wherein a distance between the S pole and the N pole at least in a vicinity of the discharge port in the magnetic body is shorter than a dimension of the discharge port in a direction that intersects a line connecting both end portions of the storage unit.

13. The powder supply device according to claim 9, wherein the magnetic body is a magnetic body in which a plurality of the S poles and a plurality of the N poles are arranged in parallel at equal intervals.

14. The powder supply device according to claim 1, wherein the magnetic body has an S pole and an N pole that are magnetized so as to be arranged in a direction in which a bottom surface of the storage unit extends.

15. The powder supply device according to claim 14, wherein the S pole and the N pole of the magnetic body extend along a line connecting both end portions of the storage unit.

16. The powder supply device according to claim 15, wherein a distance between the S pole and the N pole at least in a vicinity of the discharge port in the magnetic body is shorter than a dimension of the discharge port in a direction that intersects a line connecting both end portions of the storage unit.

17. The powder supply device according to claim 14, wherein a distance between the S pole and the N pole at least in a vicinity of the discharge port in the magnetic body is shorter than a dimension of the discharge port in a direction that intersects a line connecting both end portions of the storage unit.

18. The powder supply device according to claim 14, wherein the magnetic body is a magnetic body in which a plurality of the S poles and a plurality of the N poles are arranged in parallel at equal intervals.

19. The powder supply device according to claim 1, wherein the magnetic body is a rubber magnet.

20. The powder supply device according to claim 1, further comprising:

a transport unit including a first transport unit that transports the mixed agent stored in the storage unit toward one of a first end portion and a second end portion opposite to the first end portion, and a second transport unit that is closer to the first end portion than the first transport unit, the second transport unit that applies a transporting force to the mixed agent in an opposite direction to a direction in which the first transport unit applies a transporting force to the mixed agent.

* * * * *